United States Patent [19]

Handing

[11] 4,065,759

[45] Dec. 27, 1977

[54] SMOKE DETECTOR

[76] Inventor: Theodore E. Handing, 114 Palo Verde Drive, Brownsville, Tex. 78520

[21] Appl. No.: 647,096

[22] Filed: Jan. 7, 1976

[51] Int. Cl.[2] ..... G08B 17/10

[52] U.S. Cl. ..... 340/237.5; 250/574; 340/249

[58] Field of Search ..... 340/237, 249; 250/552, 250/574

[56] References Cited

U.S. PATENT DOCUMENTS

| | | | |
|---|---|---|---|
| 1,256,740 | 2/1918 | Steiger | 340/237.5 |
| 3,534,351 | 10/1970 | Harnden, Jr. et al. | 340/237.5 |
| 3,659,278 | 4/1972 | Jensen | 340/237.5 |
| 3,860,919 | 1/1975 | Aker | 340/237.5 X |
| 3,879,717 | 4/1975 | Gruensfelder | 340/249 |
| 3,895,367 | 7/1975 | Visser | 340/237.5 X |
| 3,906,473 | 9/1975 | Levine | 340/237 R |

*Primary Examiner*—John W. Caldwell, Sr.
*Assistant Examiner*—Daniel Myer
*Attorney, Agent, or Firm*—Rummler & Snow

[57] ABSTRACT

A smoke detector working on the principal of interference of light between an L.E.D. source and a phototransistor receiver detects differences in smoke emission regardless of the color of the smoke. A pulsating power supply automatically turns the power to the unit on and off every thirty seconds so that the life of the unit is extended and energy is conserved. When a hazardous smoke condition exists, the unit produces rapidly interrupted alarm signals. A warning signal which is different than the alarm signal draws attention to an optoelectronic system malfunction or a power supply voltage drop below a preset level.

17 Claims, 6 Drawing Figures

SMOKE DETECTOR

BACKGROUND OF THE INVENTION

Reflective-type smoke detectors work on the principle of light reflectivity of smoke particulates. An L.E.D. light emanating source is open to the interior of a smoke chamber and a phototransistor is mounted alongside thereof for reception of reflected light from the opposite direction from which it is emanated. Reflection of light from the diode actuates an alarm when the density of a given smoke therein reaches a threshold value. The smoke detection capability of reflective-type smoke detectors thus depends upon the color of the smoke, as well as upon its density. The composition of the burning material from which the smoke is emitted then becomes a question as to when a hazardous fire is present.

Light interference-type smoke detectors work on the principle of interference of a light by smoke particulates. An L.E.D. light source is open to the interior of a smoke chamber and a phototransistor is mounted in line thereof for reception of transmitted light from the same direction from which it is emanated.

The Rohm and Haas XP2 Smoke Test Chamber, recently adopted in ASTM D-2843T, and the National Bureau of Standards Smoke Chamber both use smoke analyzers of the light interference-type for the classification of smoke emissions from combusting materials. The object of these tests is to measure and compare the opacity of smoke emitted by burning specific materials under known conditions. Opacity of smoke is only related to density of smoke and does not involve smoke light-reflective characteristics in the operation of these instruments.

In the NBS Smoke Chamber, the smoke from the burning test material rises through a chamber and intercepts a vertical column of light. Transmissibility of light through the smoke in the chamber and its attenuation thereby is measured and recorded at varying smoke emissions therefrom as air vented thereto is changed. As the venting of air to the burning material increases, smoldering changes to open flame burning and open burning changes to smoke dilution by excess air and the density of the smoke emitted increases and then decreases while at the same time the light transmissibility therethrough becomes a minimum.

A common complaint of both firefighters and the fire insurance underwriters is that "you can't describe every fire." Every fire is different because each has its own heat, flame and ventilation characteristics and each has its own composition of burning materials. All parameters which describe the characteristics of a fire are rarely identical for different fires. For that matter, fire parameters can vary within a fire itself — especially if the fire is extensive or the air venting changes from place-to-place or time-to-time.

In comparing the smoke emissions of fires, certain parameters which best describe the smoke-emitting characteristics of a particular fire include the availability of oxygen to the fire, the chemical composition and the physical characteristics of the burning material on fire, and the convection, conduction and radiation of heat from the fire. Once all these parameters are known, the opacity of the smoke emitted from the fire is fixed.

Assuming smoke opacity is a sole criterion for the presence of fire, the optical density of smoke emitted therefrom forms the basis for the operation of a fire detector. Optical density of smoke depends upon both smoke particle size and the number of smoke particles in a given volume. Optical density does not depend on the color of the smoke or its light-reflecting characteristics. Smoke detectors that use optical density as a basis of operation then are to be distinguished from those that use light reflectivity for that purpose in that they are sensitive to the color of the smoke. In smoke detectors that operate on a light interference principle, the color of the smoke does not make any difference in the performance characteristics of the unit.

Existing smoke detectors operate on a continuous basis. Continuous smoke detection is not only unnecessary but is not required under existing fire prevention regulations or underwriting codes. Continuous operation of smoke detection equipment cuts short the service life of the detector and also consumes more energy than is absolutely necessary. All of these factors make for high cost of operation and maintainability of existing smoke detection equipment.

There is thus an established need for a smoke detector which works with equal sensitivity on smoke of all colors and which is more cost-effective from operational, maintenance and service-life standpoints.

SUMMARY OF THE INVENTION

The gist of this invention lies in a smoke detector of the light-interference type for the detection and alarm of the existence of hazardous smoke emissions from materials which are combusting in air having a power supply pulsing circuit as a power saving and component life increasing feature and an alarm pulsing circuit for producing rapidly interrupted alarm signals which are more likely to be noticed than a steady signal. A special warning circuit triggers a special warning signal, which is different than the alarm signal, if the light source in the optical system of the smoke detector is electrically shorted or open, or if the voltage from the power supply drops below a present level. A light emitting diode in the power pulsing circuit also gives a visible check on the power pulsing circuit operation.

When smoke or other obstruction in the smoke test chamber is removed by blowing or fanning clean air through the chamber, the alarm signals shut off and the detector circuit automatically resets. If the warning signal is initiated because of low supply voltage, the smoke detecting circuit is still operable as long as voltage is sufficient for the circuits to operate. The warning signal will continue once the smoke clears from the chamber.

In addition to the combination of circuits used in this smoke detector, a switched circuit has invention as a sub-combination thereof in that it supplied a regulated voltage only for a given length of time. At all other times output is zero. When the circuit is switched on, it is practically instantaneously at a predetermined level which neither decreases or increases during on-time, and is practically zero when switched off.

There is also invention in an alarm trigger circuit in the manner by which hysteresis is obtained, and the fact that this trigger only requires two resistors and draws practically zero current in the quiescent state while both halves conduct during on-time. This provides a power saving during the quiescent state.

The invention in a sub-combination warning trigger circuit is essentially the same as the alarm trigger circuit except that it operates in reverse thereof. In its quiescent state, it is in a state of conduction and when a control signal is applied, detriggering is accomplished and the circuit draws practically zero current while the control signal is applied. Since this circuit draws practically zero current during the time the control signal is applied, there is no voltage drop across the power source resistor, thereby the voltage from the power source will be sufficient to turn on a normal operating trigger.

Once the warning trigger circuit is detriggered, a pulse is sent through the signaling device (horn) of the smoke detector into a warning timer circuit. The energy is stored in this circuit and applied to the warning trigger circuit to retrigger this circuit for the time constant designed into the warning timer circuit.

A supply pulser circuit has essentially the same invention as the alarm trigger circuit except that with the addition of one resistor and one capacitor, the circuit will self-oscillate turning itself on and off at a predetermined unsymmetrical duty cycle. In the quiescent state, the only current drawn is by the charging resistor and capacitor.

A pulser over-ride circuit has invention when used in combination with the supply pulser circuit. When a sufficient voltage is obtained through the pulser over-ride circuit and applied to the supply pulser circuit, it will defeat the pulsing action of the supply pulser circuit and will maintain conduction of this circuit for as long as the voltage from the pulser over-ride circuit is applied.

The invention in an open short supervisor circuit lies in the fact that it operates as a nonconducting bridge in its quiescent state provided the differences between the two input voltages are below the base-emitter junction conduction minimum voltage or either part of the bridge. The input voltages to be compared may be obtained from any two sources provided the voltage compared by the bridge is within the range of the bridge. This can be accomplished by voltage divider circuits or any other well-known equivalent method. In the event that the voltages applied to the inputs of this circuit are beyond predetermined limits, collector current will flow which can be used for triggering purposes.

An alarm defeat circuit has invention when used in combination with the open-short supervisor circuit. When the open-short supervisor circuit conducts, the alarm defeat circuit also conducts, lowering the available voltage to the alarm triggering circuit thereby preventing the triggering of the alarm circuit. At the same time, the warning trigger circuit is detriggered allowing thw warning mode to commence.

An alarm pulser circuit has invention in the fact that it is a nonconducting oscillator circuit in its quiescent state. As long as voltage is present from the trigger circuit, this circuit will oscillate alternately turning on and off supplying a pulse to the signaling device.

On AC units with battery standby, there is automatic switching to battery supply when the AC voltage is low or off. There is also automatic switching back to AC when AC voltage is more than that necessary to equal the voltage supplied by the battery. An auto switch battery standby circuit comprises a diode or diodes in series with the anode connection of the battery and utilizes the characteristic of one-way current flow for the purpose of having the supply voltage to the circuit provided by the source of highest voltage. This will provide automatic switching to the source of highest voltage.

DESCRIPTION OF THE PREFERRED EMBODIMENT

Figure 1:
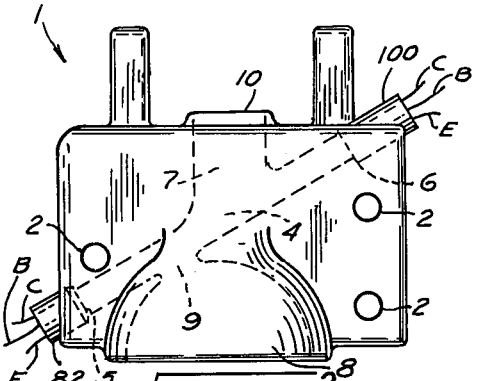
FIG. 1 shows a side view of the smoke sensor housing of this smoke detector invention.
Figure 2:
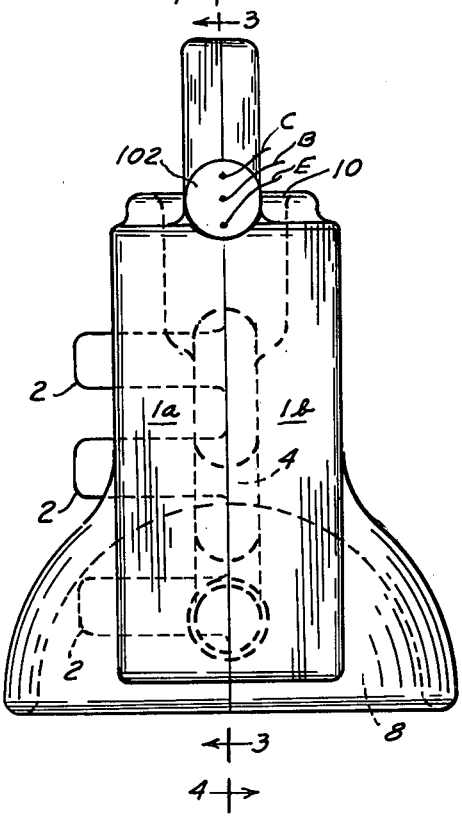
FIG. 2 shows an end view of the same.
Figure 3:
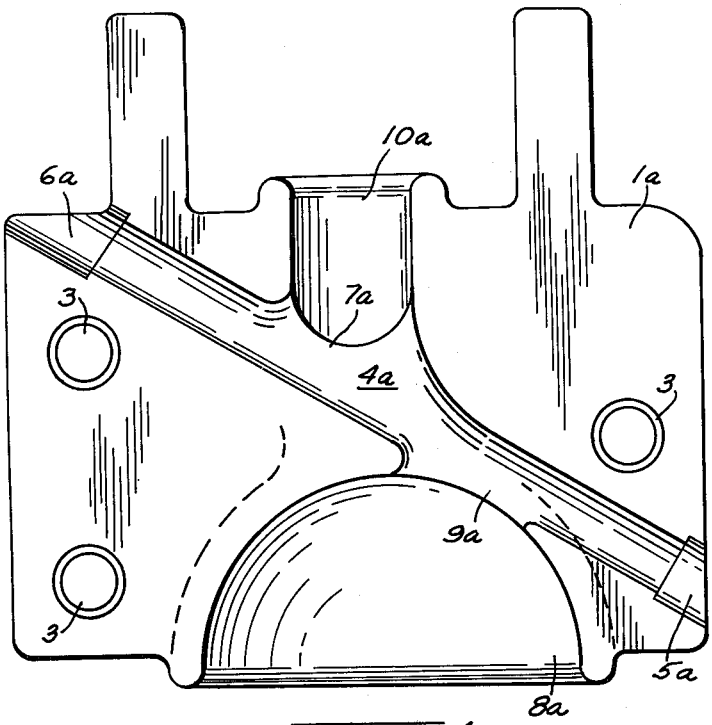
FIG. 3 shows a view of the parting plane of said housing taken along line 3—3 of FIG. 2.
Figure 4:
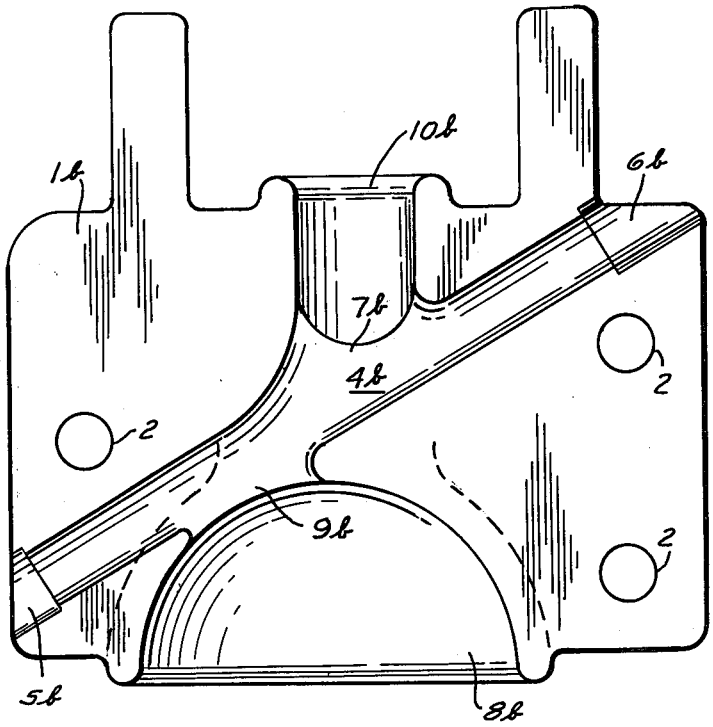
FIG. 4 shows a view of the parting plane of said housing taken along line 4—4 of FIG. 2.

Referring to FIGS. 1 and 2, the smoke test chamber of the smoke detector of this invention comprises a molded plastic housing 1. First and second housing halves 1*a* and 1*b* assemble on alignment dowel pins 2 which are secured to the parting face of housing half 1*b* and extend perpendicularly across the parting plane between halves 1*a* and 1*b* and slidingly fit into dowel pin guide-holes 3 in mating opposite housing half 1*a* thereof. A smoke test chamber 4 which locates in the body of housing 1, as shown in FIG. 1, comprises a first straight cylindrical half-bore 4*a*, which extends diagonally through housing half 1*a* in a downward, right-hand direction from left-to-right, as shown in FIG. 3, and a matching second straight cylindrical half-bore 4*b* which extends likewise through housing half 1*b* in an upward, right-hand direction from left-to-right, as shown in FIG. 4. Smoke chamber 4 extends diagonally in an upward, right-hand direction from one end to the other end of housing 1, as shown in FIG. 1, and constitutes an assembly of cylindrical half-bores 4*a* and 4*b* therein, as shown in FIG. 1.

A first receptacle 5 counterbores in the cylindrical bore 4 in housing 1 at a lower end thereof and a similar second receptacle 6 counterbores therein at its upper other end thereof, as shown in FIG. 1. A first half-receptacle 5*a*, which comprises first receptacle 5, counterbores in the lower end of half-bore 4*a* and a matching second half-receptacle 5*b* which also comprises first receptacle 5 counterbores in the lower end of half-bore 4*b*. A third half-receptacle 6*a* which comprises second receptacle 6 counterbores in the upper end of half-bore 4*b* and a matching fourth half-receptacle 6*b* which also comprises second receptacle 6 counterbores in the upper end of half-bore 4*b*.

A smoke scoop 8 of hemispherical shape mounts on and faces downward from the base of housing 1, as shown in FIGS. 1 and 2. Smoke scoop 8 fluid communicates with the smoke chamber 4 from below through a smoke inlet port 9 in the body of housing 1. Smoke vent stack 10 mounts in and faces upward from the top of housing 1 and is in fluid communication with the smoke chamber 4 from above through smoke vent port 7 in the body thereof. Vent port 7 locates at a level along the bore axis of the smoke chamber 4 above that of smoke inlet port 9.

A first half-scoop 8*a* comprising scoop 8 mounts on the base of half-housing 1*a* and a first half-stack 10*a* comprising stack 10 mounts on the top thereof, as shown in FIG. 3. Matching second half-scoop 8*b* which also comprises scoop 8 mounts on the base of half-housing 1*b* and a second half-stack 10*b* comprising stack 10 mounts on the top thereof, as shown in FIG. 4. Smoke inlet half-ports 9*a* and 9*b* which comprise port 9 in half-housings 1*a* and 1*b*, respectively, fluid communicate with the top of first and second half smoke scoopes 8*a* and 8*b* below and with the bottom of first and second cylindrical half-bores 4*a* and 4*b* comprising cylindrical bore 4 above. Smoke vent half-ports 7*a* and 7*b* comprising vent port 7 in half-housings 1*a* and 1*b*, respectively, fluid communicate with the bottom of first and second half vent stacks 10*a* and 10*b* above and with cylindrical half-bores 4*a* and 4*b* comprising cylindrical bore 4 below.

Smoke scoop and chamber mounting lugs 11 mount on and extend in an upward direction from the top of the body of housing 1 adjacent to the vent stack 10 at each end thereof, as shown in FIGS. 1 and 2. Matched mounting half-lugs 11*a* and 11*b* which comprise lugs 11 each mount on and extend in an upward direction from the tops of half-housings 1*a* and 1*b*, respectively, in adjacent face-to-face relation on each side of the parting plane of the body thereof.

Figure 5:
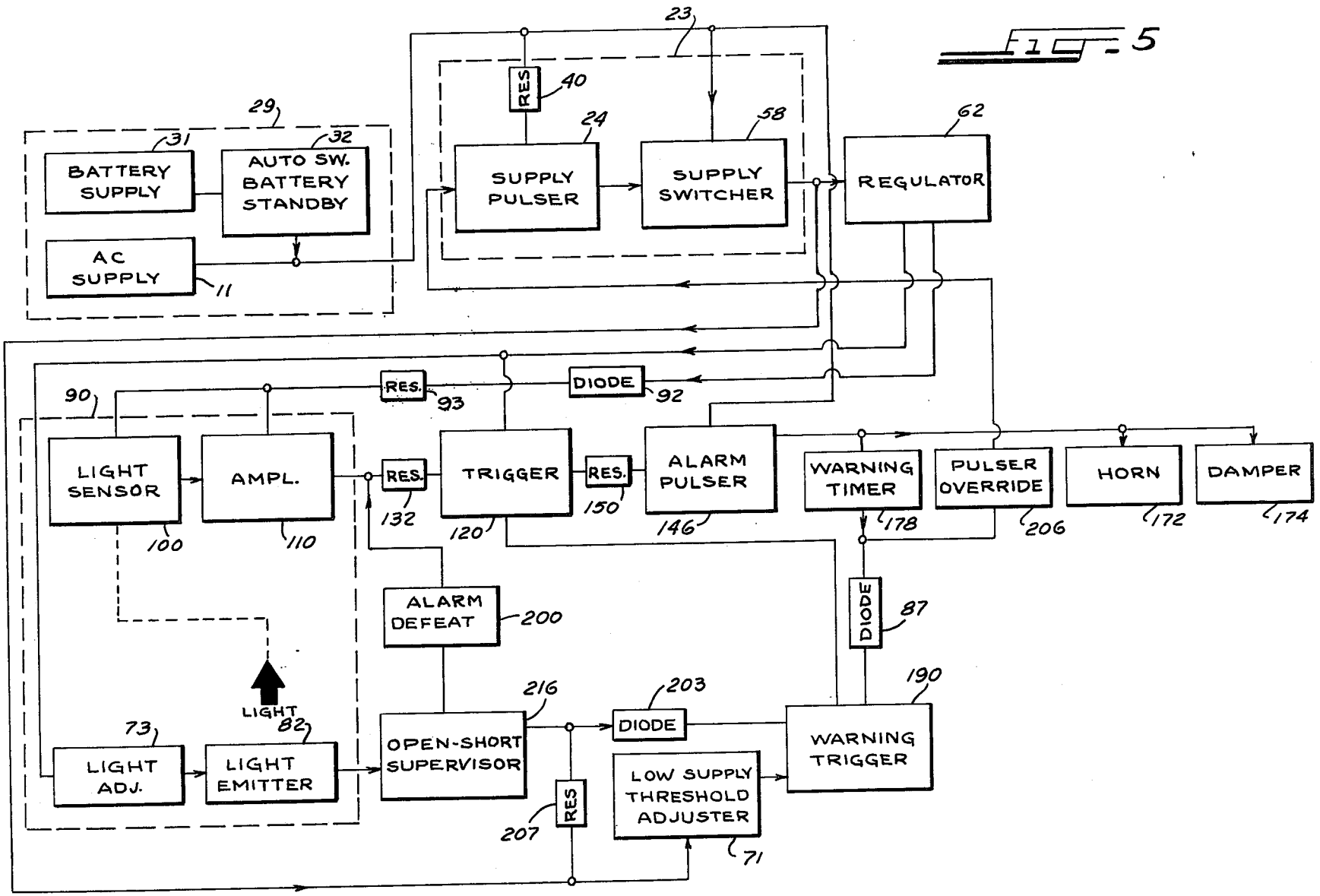
FIG. 5 is a block diagram of the electronic circuit for subject smoke detector.

Referring to FIG. 5, the block diagram of the smoke detector circuit shows a source of A.C. power 11 and a standby source of D.C. battery power 31. A.C. power source 11 and D.C. power source 31 alternatively supply an unregulated D.C. power supply bus 29 to the detector circuit through an autoswitch 32 which automatically connects the detector circuit to A.C. source 11 or D.C. source 31, whichever is higher.

As a power-saving feature, the smoke detector circuit is designed with a power supply pulsing circuit 23 which automatically turns the power to all circuits of the detector "on" and "off" so that a sampling of the atmospheric conditions within the smoke chamber 4 is taken approximately every thirty seconds, and in the event a hazardous smoke condition exists, the detector goes into smoke alarm. Pulsed D.C. power supply circuit 23 comprises a supply pulser circuit 24, which connects to the D.C. power supply bus 29 through a first resistor 40 and produces a pulsed D.C. voltage output with rapid transitions, and which, in the quiescent state, only draws current for charging an R-C circuit (not shown). A supply voltage switcher circuit 58 for supplying an unregulated pulsed D.C. voltage output to the smoke detector circuit is supplied by power from D.C. power supply bus 29 and has its input connected to the output from supply pulser circuit 24. With no current drawn by the supply pulser circuit 24, no voltage drop appears across the first resistor 40 and D.C. power supply voltage 29 is sufficient to operate supply pulser circuit 24.

A pulsed voltage supply regulator circuit 62 for supplying a regulated pulsed D.C. voltage output to the smoke detector circuit connects to the unregulated pulsed D.C. voltage output of the supply switcher circuit 58 of the power supply pulsing circuit 23. At all other times than during the duration of the voltage pulse, the output from both supply voltage switcher circuit 58 and voltage regulator circuit 62 is zero. When switcher circuit 58 is "on", voltage output therefrom is instantaneously at a predetermined level. When switcher circuit 58 is "off", voltage output therefrom is instantaneously at zero level.

Figure 6:
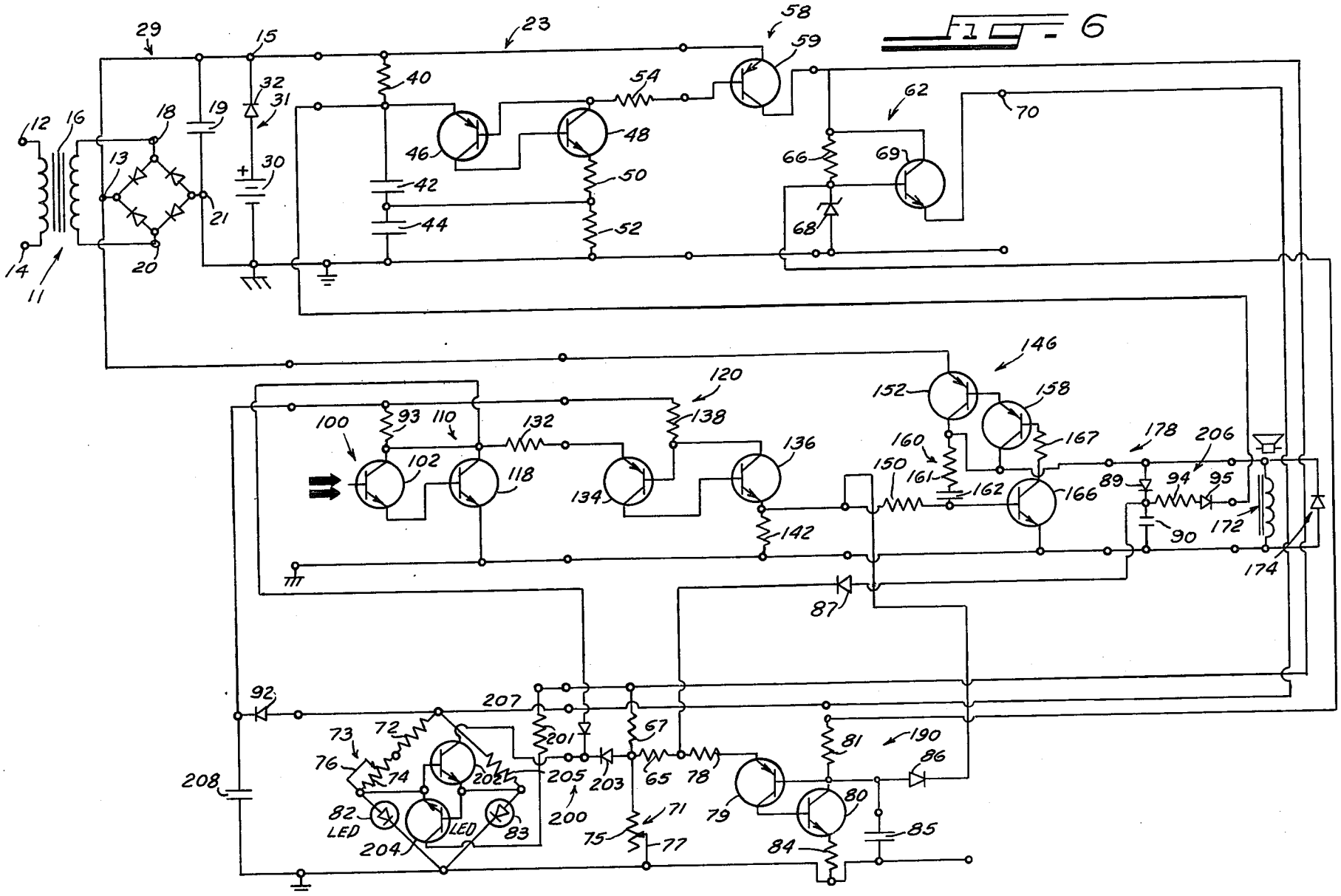
FIG. 6 is the electronic circuit diagram of the same.

A smoke sensing means 90 comprises a light-adjuster circuit 73, as shown in FIGS. 5 and 6, for calibrating the smoke-detecting sensitivity of the smoke detector which connects to the regulated pulsed D.C. voltage output from voltage regulator circuit 62. A first light emitting diode 82, which mounts in the receptacle 5 in the lower end of the smoke chamber 4, as shown in FIG. 1, connects to the attenuated regulated pulsed D.C. voltage output from the light adjuster circuit 73, and emits a beam of light of constant intensity for the duration of the D.C. voltage pulse which is focused to shine up the axis of the smoke chamber 4 into the window of a phototransistor light receiver 100 in receptacle 6 at the other end thereof. The window of the light receiver 100 is at a stated distance from the lens of the first light emitter diode 82. A light-receiving amplifier circuit 110 connects its power supply to the regulated pulsed D.C. voltage output from the voltage regulator circuit 62. The input to the light-receiving amplifier circuit 110 connects to the pulsed output of phototransistor light receiver 100.

A warning alarm signal circuit 190 for sounding a special warning signal which is different from that of the smoke alarm signal and which is used in the event that the smoke alarm signal circuit malfunctions or the voltage supplied to the circuit is insufficient for its proper operation. In its quiescent operating state, warning signal circuit 190 conducts. If the first light emitting diode 82 shorts out or opens the circuit or if the voltage on D.C. power supply bus 29 drops below a preset level, warning alarm signal circuit 190 detriggers and conducts.

An alarm trigger circuit 120 for producing an instantaneous output voltage pulse of constant amplitude in the event either the smoke alarm signal circuit 90 or the warning alarm signal circuit 190 conduct connects its power supply to the regulated pulsed D.C. voltage output of the regulator circuit 62 and a first input to the output from light-receiving amplifier circuit 110. Trigger circuit 120, which is essentially the same as warning alarm signal circuit 190 except it operates in reverse, draws practically zero current when operating in the quiescent state. A second input thereto connects to the output from the warning alarm signal circuit 190.

An alarm pulser circuit 146, which is non-conducting oscillator in its quiescent state, connects its power supply to D.C. power supply bus 29, and its input to the output from alarm trigger circuit 120. As long as output voltage is present from the trigger circuit 120, alarm pulser circuit 146 will oscillate, alternately turning on and off an interrupted rapidly pulsed voltage output therefrom. A magnetic horn 172 for sounding an alarm signal in the event that smoke is detected, the small alarm signal malfunctions or the voltage supplied is insufficient, connects its input to the pulsed output from alarm pulser circuit 146. A damper diode 174 connects in parallel with the magnetic horn 172.

A warning timer 178 connects its input to the pulsed voltage output from alarm pulser 146. Once the warning trigger 190 detriggers, a voltage passes from the horn 172 into the warning timer 178, and the energy in warning timer 178 applies to the warning trigger 190 through a diode 87 to retrigger this circuit for the time constant of the warning timer 178.

An open-short supervisor 216 that operates as a non-conducting comparison bridge in its quiescent state connects its power supplies to both unregulated pulsed D.C. voltage output from supply switcher 58 and to unregulated pulsed D.C. voltage output from regulator 62, and its input to an electrical output from the light emitter diode 82. In the event that the voltages applied to the inputs of the open-short supervisor 216 are beyond predetermined limits, collector current will flow, and an alarm defeat 200, which connects its input to a second output from the open-short supervisor 126 and its input to an input to the trigger 120, conducts and lowers the available voltage to the trigger 120 thereby preventing the triggering of the alarm pulser 146. A low-supply threshold adjuster 71 connects its input to the unregulated pulsed D.C. output voltage from supply switch 58.

The warning trigger 190 connects a first input to the output from warning timer 178 for purposes of being retriggered after the passing of a given time, a second input to a first output of open-short supervisor 216, which in the event that A.C. voltage 11 or D.C. voltage 31 are beyond predetermined limits is triggered thereby, and a third input to the output from the low-supply threshold adjuster 69. The trigger 120 connects a second input to the output of warning trigger 190.

A pluser over-ride 206 for defeating the pulsing action of the supply pulser circuit 24 connects its input to the alarm pulser output voltage from warning timer 178. The supply voltage pulser 21 connects an input to the alarm pulser output voltage from pulser over-ride 206.

Referring to FIG. 6, the circuit diagram of the smoke detector shows a source of A.C. power 11 and a source of D.C. standby power 31. A.C. source 11 comprises a first input terminal 12 connecting to a single-phase 115-volt A.C. bus (not shown), a second input terminal 14 connecting to ground (not shown) and a power transformer 16 having its primary terminals connected across A.C. input terminals thereof. D.C. source comprises a battery 30.

Unregulated D.C. power supply 29 from A.C. power source 11 comprises a standard bridge rectifier 22 having input terminals 18 and 20 connecting across the secondary terminals of transformer 16, and first and second output terminals 13 and 21 connecting therefrom with terminal 21 connecting to ground. Unregulated D.C. power supply 29 from battery power source 31 comprises an autoswitch diode 32 having its anode connected to the positive terminal of a battery and its cathode connected to lead 15 which is connected in common with output terminal 13 of the D.C. power supply 29 from the A.C. source 11. The negative terminal thereof connects to ground. A first filtering capacitor 19 shunts D.C. power supply 29 with its input connecting to common lead 15 and its output connecting to ground.

Supply voltage pulser circuit 24 of the resistance-capacitance-coupled feedback oscillator type for producing a switched D.C. current return with rapid transitions connects to the common lead from output terminals 13 and 15 of A.C./ D.C. power supplies 11 and 31, respectively, and comprises a first resistance 40 which connects its input to the common lead from the output terminals 13 and 15. A first capacitance 42 couples its input to the common lead from the output terminals 13 and 15. A second capacitance 42 couples its input to the output of the first resistance 40. A second capacitance 44 couples its input to the output of first capacitance 42. The output of second capacitance 44 couples to ground. Emitter terminal of a first PNP transistor 46 connects to the output of resistor 40. The collector terminal of first NPN transistor 48 connects to the base terminal of the first PNP transistor 46. The base terminal of the first NPN transistor 48 connects to the collector terminal of the first PNP transistor 46. A third resistor 50 connects its input to the emitter terminal of the first NPN transistor 48. A fourth resistor 52 connects its input to the output of the third resistor 50. The output of the first capacitor 42 couples to the output of the third resistor 50, and the output of the fourth resistor 52 connects to ground. A second resistor 54 connects its input to the base terminal of first PNP transistor 46 and to the collector terminal of first NPN transistor 48.

Supply voltage switcher circuit 58, for producing an unregulated pulsed D.C. voltage, connects to the common lead from output terminals 13 and 15 of A.C/D.C. power supplies 11 and 31 and comprises a second PNP transistor 59 having its emitter terminal connected to the common lead from the output terminals 13 and 15 of A.C./D.C. power supplies 11 and 31. The base terminal of second PNP transistor 59 connects to the output of second resistor 54 in supply pulser circuit 24.

Voltage regulator circuit 62 for supplying regulated pulsed D.C. voltage to first light emitter diode 82, light receiving amplifier 110 and trigger 120 comprises a fifth resistor 66 having its input connected to the collector terminal of second PNP transistor 59 of switcher circuit 58. A Zener Diode 68 connects its cathode to the output from the resistor 66 and its anode to ground. A second NPN transistor 69 connects its collector terminal to the collector terminal of second PNP transistor 59 and its base terminal connects to the output from resistor 66. Output terminal 70 of pulsed D.C. voltage regulator 62 connects to the emitter terminal of second NPN transistor 69.

Light adjuster circuit 73 for calibrating the sensitivity of the smoke detector comprises a first potentiometer resistance 74 therein which is connected through a sixth resistor 72 to the output terminal 70 of the pulsed voltage regulator 62. A contact arm 76 which mounts across the first potentiometer resistance 74 and in electrical contact therewith provides adjustable resistance between the input to first potentiometer resistance 74 and the point of contact thereon of contact arm 76.

First light emitter diode 82 for emitting pulsed light of constant intensity connects its anode terminal to the output of the contact arm 76 of the light adjuster circuit 73 and its cathode to ground.

Low supply voltage threshold adjuster circuit 71 for adjusting a pulsed unregulated D.C. voltage output from the switcher circuit 58 comprises a second potentiometer resistance 75 which is connected through a sixteenth resistor 67 to the collector terminal of second PNP transistor 59 of the switcher circuit 58. A contact arm 77 which mounts across the second potentiometer 75 and in electrical contact therewith provides adjustable resistance between the input to second potentiometer resistance 75 and the point of contact of contact arm 77 thereon. The output of contact arm 77 connects to ground.

Light receiver 100 for converting the pulsed light of constant intensity from the first light emitter diode 82 to a pulsed current output comprises an NPN phototransistor 102 which has its collector connected through a seventh resistor 93 to the cathode of a first diode 92. The anode of first diode 92 connects with the regulated pulsed D.C. voltage output from terminal 70 of voltage regulator 62. The pulsed light from the first light emitter diode 82 shines on the base of phototransistor 102.

Light amplifier circuit 110 for producing phototransistor amplifier output voltage and amplifying the pulsed current output from the NPN phototransistor 102 comprises a third NPN transistor 118 which also has its collector connected through the seventh resistor 93 to the cathode of first diode 92 and thence to the regulated D.C. pulsed voltage output from terminal 70.

The base of third NPN transistor 118 connects to the emitter of NPN phototransistor 102. The emitter of third NPN transistor 118 connects with ground. An eighth resistor 132 connects its input to the collector of third NPN transistor 118 and its output to the output terminal of amplifier 110.

Trigger circuit 120 for producing a positive trigger output voltage pulse of constant amplitude for only so long as a positive input voltage thereto exceeds a triggering value comprises a third PNP transistor 134 having its emitter connected to the output of eighth resistor 132 and its base connected through a ninth resistor 138 to cathode of first diode 92 and thence to the regulated D.C. pulsed voltage output from terminal 70. A fourth capacitor 208 connects the cathode of first diode 92 to ground. The base of fourth NPN transistor 136 connects to the collector of third PNP transistor 134. The emitter of fourth NPN transistor 136 connects across a tenth resistor 142 to ground. An eleventh resistor 150 connects at one end to the emitter of fourth NPN transistor 136.

Alarm pulser circuit 146 for producing an alarm pulser output voltage and sounding the alarm signal on horn 172 comprises a fourth PNP transistor 152 having its emitter connected to the common lead from output terminals 13 and 15 of A.C./ D.C. power supplies 11 and 31, respectively. An R-C circuit 160 comprising a twelfth resistor 161 having one end connected to the collector of fourth PNP transistor 152 and a third capacitor 162 coupled on one side to the other end thereof connects to the other end of eleventh resistor 150 on the other side thereof. A fifth PNP driving transistor 158 connects its emitter to the base of fourth PNP transistor 152 and its collector to the collector thereof. A fifth NPN transistor 166 connects its collector through a thirteenth resistor 167 to the base of fifth PNP transistor 158. The base of fifth NPN transistor 166 connects to the common lead from the other end of eleventh resistor 150 and couples to the other side of the third capacitor 162 of R-C circuit 160. The emitter thereof connects to ground.

Open-short supervisor circuit 216 for triggering a signal device in the event that first light emitting diode 82 open-circuits or shorts out or the A.C. or D.C. supply voltages are beyond predetermined limits comprises a sixth PNP transistor 204 having its emitter connected to the anode of first light emitting diode 82 and a sixth NPN transistor 202 having its base also connected to the anode thereof and its emitter in turn connected to the base of sixth PNP transistor 204. A second light emitting diode 83 has its anode connected to the base of sixth PNP transistor 204 and to the emitter of sixth NPN transistor 202 and its cathode connected to ground. A fourteenth resistor 205 connects the anode of second lightemitting diode 83 to the regulated D.C. pulsed voltage output from terminal 70. A fifteenth resistor 207 connects at one end to the collector of sixth PNP transistor 204 and at its other end to the collector of second PNP transistor 59 in voltage supply switcher 58.

Alarm defeat circuit 200 for preventing the triggering of alarm pulser 146 when the open-short supervisor 216 conducts comprises a second diode 201 having its cathode connected to the collector of sixth NPN transistor 202 in the open-short supervisor 216 and its anode connected to the collector of third NPN transistor 118 in the light receiving amplifier 110.

Warning trigger circuit 190 comprises a seventeenth resistor 65 which is connected at one end to the anode of third diode 203 in the output circuit from the open-short supervisor circuit 216 and to the unregulated D.C. voltage output from switch circuit 58 through sixteenth resistor 67. An eighteenth resistor 78 connects at one end to the other end of seventeenth resistor 65. A seventh PNP transistor 79 connects its emitter to the other end of eighteenth resistor 78. A seventh NPN transistor 80 connects its base to the collector of seventh PNP transistor 79 and its collector to the base thereof. A nineteenth resistor 81 connects one end to the other end of fifth resistor 66 in voltage regulator circuit 62 and the other end to the collector of seventh PNP transistor 80. A twentieth resistor 84 connects at one end to the emitter of seventh NPN transistor 80 and at the other end to ground. A fifth capacitor 85 bypasses seventh NPN transistor 80 from collector to ground. A fifth diode 86 connects its anode to the collector of seventh NPN transistor 80 and couples its cathode to the emitter of fourth NPN transistor 136 at the output from trigger circuit 120. A fourth diode 87 connects its cathode to the other end of seventeenth resistor 65.

Warning timer circuit 178 comprises a sixth diode 89 having its anode connected to the collector of fifth PNP transistor 158 in alarm pulser circuit 146. A sixth capacitor 90 couples one side to the cathode of sixth diode 89 and the other side to ground. The anode of fourth diode 87 in the warning trigger circuit 190 connects to the cathode of sixth diode 89 and the one of the sixth capacitor 90 of warning timer circuit 178.

Pulser override circuit 206 comprises a twenty-first resistor 94 having one end connected to the cathode of sixth diode 89 and the one side of sixth capacitor 90 of the warning timer circuit 178. A seventh diode 95 connects its anode to the other end of twenty-first resistor 94 and its cathode to the other end of first resistor 40 at the emitter of first PNP transistor 46 in supply pulser circuit 23.

The smoke detector of this invention operates on a principle of interference of a light beam confined within the smoke chamber 4. The first light emitting diode 82 is used for the light source and NPN phototransistor 102 is used as a receiver to detect an interference with the light source by the smoke when present. Because of the smoke chamber 4 design, smoke enters the smoke chamber 4 and is accumulated therein to interfere with the light beam emanating from the first light-emitting diode 82 to the light-receiving NPN phototransistor 102. Since the detector unit operates on a light interference principle, the color of the smoke does not make any difference in the performance of the unit.

The alarm signal is provided through an alarm pulsing circuit 146 to the magnetic horn 172. The purpose of the alarm pulsing is to cause an interrupted rapid signal which is more likely to be noticed than a steady signal. For additional safety, the special warning circuit 190 triggers a special warning signal different from the smoke alarm pulsing signal in the event the first light-emitting diode 82 is shorted or open, or the voltage from the D.C. power supply 29 drops below a preset level. The lower the voltage drops, the more frequently the special warning signal will be given until the voltage drops below that necessary to operate the circuits. There is also a second light-emitting diode 83 which will blink on and off approximately every thirty seconds indicating that the power pulsing circuit 23 is operating.

In the operation of the light-receiving amplifying circuit 90, assume the supply pulser circuit 23, supply switcher circuit 58 and regulator circuit 62 are in the "on" state. With no smoke in the smoke chamber 4, the current flow in the base of NPN phototransistor 102 is at level 1. NPN phototransistor 102 is conducting. Third NPN transistor 118 is also conducting and the output voltage therefrom is amplified to a level less than that positive voltage input necessary to trigger the following trigger circuit.

With smoke present, the current flow in the base of NPN phototransistor 102 approaches level 0; therefore NPN phototransistor 102 stops conducting. Third NPN transistor 118 also then become nonconducting so that a positive voltage level appears at the collector thereof by reason of a lower voltage drop across seventh resistance 93 resulting from the dropoff of a current flowing therethrough.

The supply voltage pulser circuit 23 operates as a latching oscillator whose output is a function of D.C. current flow with rapid transitions. Two states exist, full current flow and zero current flow through second resistor 54. First PNP transistor 46 must conduct in order for first NPN transistor 48 to conduct. At the start of operation, a level of voltage is present at the junction of the base of first PNP transistor 46, the collector of first NPN transistor 48 and the second resistor 54 with no current flow through the second resistor 54. First capacitor 42 charges through fourth resistor 52 and first resistor 40 to a level exceeding the first PNP transistor 46 base voltage by a value equal to its base-emitter forward conducting requirement. At this voltage level on first PNP transistor 46, emitter conduction therein is started thereby causing to appear at first PNP transistor 46 collector a positive voltage. This same voltage is also presented to the base of first NPN transistor 48 and is a magnitude sufficient to start conduction thereof. Upon conduction of first NPN transistor 48, the collector voltage thereof is reduced. This same reduction as presented to the base of first PNP transistor 46 is of sufficient reduction to cause it to saturate and thereby increase its collector voltage to a level sufficient to present first NPN transistor 48 base for saturation thereof. Upon saturation of both first PNP transistor 46 and first NPN transistor 48, maximum current is flowing through the second resistor 54. Third resistor 50 and fourth resistor 52 serve as the ground return for currents drawn by first PNP transistor 46 and first NPN transistor 48 during saturation. Their additional function is to present a lower level charging voltage of opposite polarity to first capacitance 42. At the end of opposite polarity charging time (which is in effect subtracting from the original charge), first PNP transistor 46 emitter voltage with reference to its base drops below the conduction level thereof and it ceases to conduct. Thereby first NPN transistor 48 ceases to conduct. At this time, first capacitance 42 recharges and the cycle repeats. The time from triggering of first PNP transistor 46 on to cut off of first NPN transistor 48 marks the duration of a current pulse through the second resistor 54, the duration of which is controlled by the decharging time constant of the first capacitance 42, third resistor 50 and fourth resistor 52. The frequency of recurrence is controlled by the charging time constant of first capacitance 42, third resistor 50 and first resistor 40.

The D.C. power supply switching circuit 58 operates as follows. Second PNP transistor 59 has an input positive D.C. voltage to its emitter at all times. With zero current flowing in the base circuit of second PNP transistor 59, zero voltage is present at the collector thereof. Current pulses initiate by the supply pulser circuit 24 cause a current to flow in the base of second PNP transistor 59. This current flow is sufficient to drive second PNP transistor 59 into saturation thereby causing the positive D.C. supply voltage less the collector to emitter saturation voltage to appear at the collector. The periodic voltage present at the collector of second PNP transistor 59 constitutes an unregulated pulsed voltage output therefrom.

In the operation of D.C. line voltage regulator circuit 62, second NPN transistor 69 functions as a series variable resistor from its collector to its emitter. While holding the base of second NPN transistor 69 at a constant voltage, the emitter thereof is considered to have a given resistance load to ground. From ground, two paths of current flow, one path from ground to the emitter to the base and one path from ground to the emitter to the collector of said second NPN transistor 69. Since the emitter to base path is a forward biased diode junction, a definitely and relatively constant voltage drop exists. Transistor theory dictates that for collector current to flow in second NPN transistor 69, base current must flow. Therefore, if the collector voltage thereof rises above level one, the path from ground to emitter to collector would normally cause an increase in voltage appearing across the resistance load from ground to emitter. However, such an increase would remove the forward bias of the emitter to base diode junction of said second NPN transistor 69 thereby going to a nonconducting state for the collector which in turn would reduce the voltage across the load resistance which would reinstate conduction for the emitter to base diode junction and thereby the emitter to collector conduction thereof. Since these transitions are self-correcting, an equalization takes place and thereby base voltage less emitter to base voltage will appear at the emitter of second NPN transistor 69 and therefore serve as a source of regulated voltage. Zener diode 68 in effect permits a voltage to rise from zero to a given value but no further. Any additional voltage is consumed as current thereby the voltage drop across the Zener supply fifth resistor 66 will increase but let the voltage across the Zener diode 68 remain relatively constant. This relatively constant voltage is used by the base of second NPN transistor 69 as a reference and bias source. Since no storage capacitors are involved, the regulated output voltage has rapid transitions from zero to full, then to zero. The voltage across the reference Zener diode 68 is also used as a source of regulated voltage for small current drain. The level is several tenths of a volt greater than the output appearing at the emitter of second NPN transistor 69 regulator.

Warning trigger circuit 190 triggers horn 172 for a very short time in the event that the open-short supervisor circuit 216 operates as a nonconducting comparison bridge in its quiescent state when the differences between the first L.E.D. 82 and second L.E.D. 83 input voltages are beyond the base-emitter junction conduction minimum voltages of either. In the event first L.E.D. 82 or second L.E.D. 83 are open-circuited or shorted out and their respective conduction minimum voltages are beyond predetermined limits, or the unregulated D.C. voltage output from supply switcher 58, or the regulated D.C. voltage output from voltage regulator 62, as established within range of the circuit 216 by voltage divider circuit 71, are beyond said predetermined limits collector current will flow from the output of open-short supervisor circuit 216 to trigger horn 172.

Seventh NPN transistor 80 and seventh PNP transistor 79 are normally in the conduction state during "on" time of voltage regulator. Therefore the collector voltage of seventh NPN transistor 80 as supplied by nineteenth resistor 81 is low. Conduction voltage having been established at the emitter of seventh PNP transistor 79 by eighteenth resistor 78, seventeenth resistor 65 and sixteenth resistor 67 from the unregulated supply switcher collector of second PNP transistor 59. Sixteenth resistor 67 and potentiometer resistor 75 in low supply threshold adjuster 71 form a voltage division adjustment whereby if the unregulated positive supply voltage from the collector of the second PNP transistor 59 drops below a predetermined value, the source for seventeenth resistor 65 will likewise drop thereby conduction of seventh PNP transistor 79 stops and therefore conduction of seventh NPN transistor 80 ceases. With no current flow through seventh PNP transistor 79 and seventh NPN transistor 80, the voltage at the junction of nineteenth resistor 81 and the anode of fifth diode 86 rises to a level sufficient to cause current flow therethrough and thereby energizes trigger alarm pulser 146. The voltage presented to the horn 172 will charge sixth capacitor 90 via sixth diode 89 and this same charge of voltage will present a sufficient amplitude via fourth diode 87 and eighteenth resistor 78 to the emitter of seventh PNP transistor 79 to cause conduction of seventh NPN transistor 80 and seventh PNP transistor 79 therby halting alarm horn 172. Since the alarm horn 172 is sounded for a very short time, the description "warning" is assigned.

The trigger circuit 120 is a bi-stable voltage pulse generator in which a positive output voltage pulse of constant amplitude exists only so long as the positive input voltage thereto exceeds a triggering value. The circuit 120 converts a positive input voltage level change to an output voltage level with sharp transitions. Third PNP transistor 134 and fourth NPN transistor 136 combine to give a thyratron-like action wherein both third PNP transistor 134 and fourth NPN transistor 136 are either in full-on or full-off state. The circuit 120 may be triggered into either state to form the level of a voltage pulse.

In the off-state, the emitter voltage of the third PNP transistor 134 is less than the regulated voltage supplied to the trigger circuit 120 from voltage regulator 62 and therefore the base voltage thereof. Collector voltage of the fourth NPN transistor 136 equals this regulated supply voltage. Third PNP transistor 134 and fourth NPN transistor 136 are cut off as it takes several tenths of a negative voltage bias on the base relative to the emitter of third PNP transistor 134 to cause it to conduct, and a positive volt bias on the base relative to the emitter of fourth NPN transistor 136 to conduct. A positive trigger voltage level of one at the input of the trigger circuit 120 will drive third PNP transistor 134 into conduction, causing a positive voltage to appear at the collector thereof and therefore the same positive voltage appears at the base of fourth NPN transistor 136. This positive voltage drives fourth NPN transistor 136 into conduction and lowers the collector voltage thereof and the voltage at the base of transistor 134 relative to the emitter voltage of third PNP transistor 134. Thereby third PNP transistor 134 is driven into saturation. The resulting saturation of third PNP transistor 134 causes a maximum positive voltage to appear at the collector thereof. This same positive voltage appears at the base of fourth NPN transistor 136 and drives the same into saturation. Third PNP transistor 134 stands saturated and conducting as long as the base voltage is biased several tenths of a volt below the emitter voltage thereof. When the emitter voltage of third PNP transistor 134 falls below this value, third PNP transistor 134 will unsaturate and stop conducting terminating the positive voltage to the base of fourth NPN transistor 136 thereby unsaturating and stopping conduction of the same. With conduction and saturation of third PNP transistor 134 and fourth NPN transistor 136, a positive voltage level appears at the emitter of fourth NPN transistor 136. With no conduction of third PNP transistor 134 and fourth NPN transistor 136, the emitter of fourth NPN transistor 136 stands at zero level.

When the voltage input on the alarm pulser circuit 146 from the trigger circuit 120 is at zero level, indicating no smoke in the chamber, the base and emitter voltages on fifth NPN transistor 166 are also at zero level and fifth NPN transistor 166 nonconducts. Fourth PNP transistor 152 and fifth PNP transistor 158 are also nonconducting because base voltages of both are equal to emitter voltages thereof. Output voltage from the alarm pulser circuit 146 is at zero level so the norm 172 which is connected thereto is not sounding the alarm signal.

When the voltage output from the trigger circuit 120 is pulsed to level one, the base voltage on fifth NPN transistor 166 exceeds the emitter voltage thereon and fifth NPN transistor 166 becomes conducting. The base voltages of both fourth PNP transistor 152 and fifth PNP transistor 158 then are less than the emitter voltages thereof and both conduct through the horn and sound the same. Series R-C feedback network comprising third capacitance 162 charges through twelfth resistance 161 and base to emitter of fifth NPN transistor 166 thereby saturating the same. When third capacitance 162 has reached its maximum charge, fifth NPN transistor 166 can no longer maintain saturation. Since eleventh resistor 150 is of sufficiently high value that conduction of fifth NPN transistor 166 can be initiated but cannot sustain saturation, the collector current thereof is reduced thereby reducing the voltage present at the collectors of fourth PNP transistor 152 and fifth PNP transistor 158 which in turn presents a negative charge from the third capacitor 162 to be applied to the fifth NPN transistor 166 base thereby ceasing all conduction therein and therefore no conduction in fourth PNP transistor 152 and fifth PNP transistor 158 and therefore no plus voltage will appear at the collectors thereon and the horn 172 stops sounding. After third capacitance 162 fully discharges, the voltage present at the base of fifth NPN transistor 166 is no longer negative and the voltage (as presented by eleventh resistor 150) begins to rise in a positive direction to a level to start conduction of fifth NPN transistor 166 and the cycle repeats and the circuit oscillates and the horn 172 intermittently sounds as long as the input voltage thereto from the trigger circuit 120 is at level one. Both will stop when this voltage is reduced to zero or ground level.

The open short supervisor circuit 216 and the alarm defeat circuit 200 operate as a means of detecting a malfunction of a light emitting source. Sixth PNP transistor 202 and sixth NPN transistor 204 comprise the detecting portion of a balanced bridge. Under no fault conditions the collectors of both have a positive voltage supplied by fifteenth resistor 207. Sixth PNP transistor 202 and sixth NPN transistor 204 have essentially the same voltage applied to their respective bases and emitters, thereby no current flow exists therethrough, or through fifteenth resistor 207. This same potential appears on the collectors of sixth PNP transistor 202 and sixth NPN transistor 204 and also back-biases second and third diodes 201 and 203, respectively. Therefore no current flows through these components. With a shorted first LED 82 fault condition, the forward bias of base to emitter of sixth PNP transistor 204 would cause its collector to draw current and thereby reduce the voltage applied to the collectors of both sixth PNP transistor 202 and sixth NPN transistor 204. With an open first LED 82 fault condition, the forward bias of base to emitter of sixth PNP transistor 202 would cause its collector to draw current and thereby have a similar reduction in the voltage applied to the collectors thereof. Second LED 83 fault conditions have similar effects on the voltage applied to sixth PNP transistor 202 and sixth NPN transistor 204. That is second LED 83 open fault condition causes sixth NPN transistor 204 to draw collector current. Second LED 83 short fault condition causes sixth PNP transistor 202 to draw collector current. With either sixth PNP transistor 202 or sixth NPN transistor 204 current flow the voltage previously applied is clamped thereby reducing the voltage at junction of sixteenth resistor 67 and seventeenth resistor 65 and thereby triggering seventh PNP transistor 79 and seventh NPN transistor 80 out of conduction and therefore the warning trigger circuit 190 produces the same effect as if a low supply voltage existed. Since a fault condition of first LED 82 would have the same effect as blockage of light by smoke and thereby trigger alarm mode, second diode 201 is used as an alarm defeat circuit 200. That is, when the open short supervisor circuit 216 draws current, the current is also drawn through second diode 201 and thereby clamps transistor 118 collector voltage at a low value thereby preventing third NPN transistor 118 collector voltage from rising to a level sufficient to trigger alarm pulser 146 into alarm mode.

Alarm trigger 120, alarm pulser 146, warning trigger 180, open short supervisor 216 and first light emitter 82 are operable only during the "on" time of the voltage regulator 62 as controlled by the supply pulser 23. If during this "on" time any circuit is required to energize the horn 172, it will do so and as a result charge sixth storage capacitor 90 via sixth diode 89. Sixth capacitor 90 discharges through twenty-first resistor 94 and seventh diode 95 to first PNP transistor 46 emitter thereby extending conduction time of supply pulser 23 over that which would normally be terminated by first capacitor 42, fourth resistor 52 and third resistor 50. Supply pulser 23 and therefore the voltage regulator 62 will remain in the "on" state as long as sixth capacitance 90 maintains a charge or is recharged by the voltage across the horn 172 during horn sounding.

The magnetic horn 172 utilized in this smoke detector possesses the inductive property such as will generate a counter E. M. F. in the form of a negative voltage across its terminals when abruptly switched from sounding to no sounding by alarm pulser 146. Since the alarm pulser 146 is in the off state during the no sounding condition of the horn 172, the negative voltage generated by counter E. M. F. therein would be of sufficient magnitude to rupture the internals of the fifth PNP transistor 158 driving said horn 172. The damper diode 174 serves to dissipate this stored energy by allowing the negative voltage spike across it to return to the opposite side of the horn 172 which in effect provides a return path for dissipation. Since the damper diode 174 is a low impedance device, the voltage appearing across it and presented to the driving fifth PNP transistor 158 is of a very low safe value. During horn 172 sounding the damper diode 174 is in effect back-biased and thereby not conducting.

Although but one specific embodiment of this invention is herein shown and described, it will be understood that details of the construction shown may be altered or omitted without departing from the spirit of the invention. For instance, in the preferred embodiment all transistors were specified as to type, NPN or PNP. It is possible, by changing all the NPN transistors therein for PNP transistors and vice versa, and in addition changing the polarities associated with each specific transistor, to obtain the equivalent invention as defined by the following claims.

I claim:

1. A smoke detector operating on the principle of interference of light by smoke comprising:

a. a smoke test chamber;

b. a source of D.C. power including an output and a ground;

c. a pulsed D.C. power supply including an input operationally connected to the source of D.C. power and an output;

d. a pulsed D.C. power supply regulator having an input operationally connected to the output of the pulsed D.C. power supply, and an output;

e. a smoke sensing means including a source of light and a light receiver in fluid communication with the smoke test chamber and operationally connected to the output from the pulsed D.C. power supply regulator;

f. an alarm trigger having an input operationally connected to the output from the pulsed D.C. power supply regulator and to the output from the smoke sensing means;

g. an alarm pulser having an input operationally connected to the outputs from the alarm trigger and the source of D.C. power; and h. an alarm means having an input operationally connected to the output from the alarm pulser.

2. In a smoke detector as set forth in claim 1 wherein the pulsed D.C. power supply comprises:

a. a first resistor operationally connected at one end to the source of D.C. power;

b. a power supply pulser having an input operationally connected to the other end of said first resistor and an output;

c. a second resistor operationally connected at one end to the output from the power supply pulser; and d. a power supply switcher having an input junction operationally connected to the source of D.C. power, and its output junction to the output from the pulsed D.C. power supply, and having its base connected to the other end of said second resistor.

3. In a smoke detector as set forth in claim 3 wherein the power supply pulser comprises:

a. a first capacitor operationally connected at one plate to the other end of said first resistor;

b. a second capacitor operationally connected at one plate to the other plate of said first capacitor and having its other plate operationally connected to ground;

c. a first transistor having one junction operationally connected to the other end of said first resistor and having its base connected to the one end of the second resistor;

d. a second transistor having one junction operationally connected to the one end of the second resistor and having its base connected to the other junction of the first transistor;

e. a third resistor having one end operationally connected to the other junction of the second transistor and its other end operationally connected to the other plate of said first capacitor; and f. a fourth resistor having one end operationally connected to the other end of the third resistor and its other end operationally connected to ground; whereby the polarities associated with the operational connection of the first and second transistors in the power supply pulser are such as to produce pulsation of the power supply.

4. In a smoke detector as set forth in claim 3 wherein the power supply switcher comprises a third transistor having its input junction operationally connected to the source of D.C. power, and its output junction connected to the output from said pulsed D.C. power supply, and having its base connected to the other end of the second resistor; whereby the polarities associated with the operational connection of the third transistor in the power supply switcher are such as to produce switching of the power supply.

5. In a smoke detector as set forth in claim 1 wherein the pulsed D.C. power supply regulator comprises:

a. a fifth resistor operationally connected at one end to the output from the pulsed D.C. power supply;

b. a fourth transistor having its input junction operationally connected to the output from the pulsed D.C. power supply, and its output junction to the output from the pulsed D.C. power supply regulator, and having its base connected to the other end of said fifth resistor; and c. a Zener diode operationally connected to the other end of said fifth resistor and to ground; whereby the polarities associated with the operational connection of the fourth transistor and the Zener diode in the pulsed D.C. power supply regulator are such as to produce regulation of the pulsed D.C. power supply.

6. In a smoke detector as set forth in claim 1 wherein the alarm trigger comprises:

a. an eighth resistor having one end operationally connected to the output from the smoke sensing means;

b. a ninth resistor having one end operationally connected through the first diode to the output of the pulsed D.C. power supply regulator;

c. a sixth transistor having its input junction operationally connected to the other end of the eighth resistor and its base connected to the other end of the ninth resistor; and d. a seventh transistor having its input junction operationally connected to the other end of the ninth resistor, and its base connected to the output junction of the sixth transistor, and having its output junction connected to the ungrounded end of a grounded tenth resistor and to the output from the alarm trigger;

whereby the polarities associated with the operational connection of the first diode, the sixth transistor and the seventh transistor in the alarm trigger are such as to produce triggering of the alarm.

7. In a smoke detector as set forth in claim 1 wherein the alarm pulser comprises:

a. an eleventh resistor having one end operationally connected to the output from the alarm trigger;

b. a third capacitor having one plate operationally connected to the other end of the eleventh resistor;

c. a twelfth resistor having one end operationally connected to the other plate of the third capacitor;

d. an eighth transistor having its input junction operationally connected to the source of D.C. power and its output junction connected to the other end of the twelfth resistor;

e. a ninth transistor having its input junction operationally connected to the base of the eighth transistor, and its output junction connected to the other end of the twelfth resistor, and having its base connected to the output from the alarm pulser;

f. a thirteenth resistor having one end operationally connected to the base of said ninth transistor; and g. a tenth transistor having its base operationally connected to the other end of the eleventh resistor, and one junction connected to the other end of the thirteenth resistor, and its other junction connected to ground; whereby the polarities associated with the operational connection of the eighth, ninth and tenth transistors in the alarm pulser are such as to pulse the alarm.

8. In a smoke detector as set forth in claim 1 wherein the alarm means comprises a magnetic horn operationally connected to the output of the alarm pulser and to ground; whereby the polarities associated with the operational connection of the magnetic horn in the alarm means are such as to sound the horn.

9. In a smoke detector as set forth in claim 1, the improvement in open-short supervisor comprising:

a. a fourteenth resistor and a fifteenth resistor in series connection with one end of a first potentiometer resistor, each having one end operationally connected to the output of the pulsed D.C. power supply regulator;

b. a second L.E.D. having its anode operationally connected to the other end of the fourteenth resistor and its cathode to ground;

c. a first L.E.D. having its anode operationally connected to the other end of the first potentiometer resistor and its cathode to ground;

d. an eleventh transistor having its base operationally connected to the anode of the first L.E.D., one junction connected to the anode of the second L.E.D. and its other junction connected to the output from the open-short supervisor; and e. a twelfth transistor having its base operationally connected to one junction of the eleventh transistor, one junction connected to the output from the pulsed D.C. power supply through a sixteenth resistor, and the other junction connected to the anode of the first L.E.D.;

whereby the polarities associated with the operational connection of the eleventh and twelfth transistors in the open-short supervisor are such as to detect open and short circuits.

10. In a smoke detector as set forth in claim 9, the improvement in alarm defeat comprising a second diode operationally connecting the output from the open-short supervisor and the input junction of the amplifying transistor; whereby the polarities associated with the operational connection of the second diode in the alarm defeat is such as to defeat the alarm.

11. In a smoke detector as set forth in claim 1, the improvement in warning trigger comprising:

a. a seventeenth resistor having one end operationally connected to a third diode and the other end to the output of the pulsed D.C. power supply;

b. an eighteenth resistor having one end operationally connected to the one end of the seventeenth resistor;

c. a fourth diode operationally connected to the other end of the eighteenth resistor;

d. a twentieth resistor having one end connected to the other end of the eighteenth resistor;

e. a thirteenth transistor having one junction operationally connected to the other end of the twentieth resistor and its base connected to the one end of a twenty-first resistor;

f. a fourteenth transistor having its base operationally connected to the other junction of the thirteenth transistor, and one junction connected to the base of the thirteenth transistor;

g. a twenty-second resistor having one end operationally connected to the other junction of the fourteenth transistor and the other end to ground;

h. a fifth capacitor having one plate operationally connected to the base of the thirteenth transistor and its other plate operationally connected to ground; and i. a fifth diode operationally connected to the one junction of the fourteenth transistor;

whereby the polarities associated with the operational connection of the fourth and fifth diodes and the thirteenth and fourteenth transistors in the warning trigger are such as to trigger a warning.

12. In a smoke detector as set forth in claim 1, the improvement in a warning timer comprising:

a. a sixth diode having its anode operationally connected to the output junction of the ninth transistor and its cathode connected to the anode of the fourth diode; and b. a sixth capacitor having one plate operationally connected to the cathode of the sixth diode and its other plate operationally connected to ground;

whereby the polarities associated with the operational connection of the fourth and sixth diodes and the ninth transistor in the warning timer are such as to time the warning.

13. In a smoke detector as set forth in claim 1, the improvement in a pulser override comprising:

a. a twenty-third resistor operationally connected at one end to the cathode of the sixth diode; and b. a seventh diode having its anode operationally connected to the other end of the twenty-third resistor and its cathode connected to the other end of the first resistor;

whereby the polarities associated with the operational connection of the sixth and seventh diodes in the pulser override are such as to override pulsation of the power supply.

14. In a smoke detector as set forth in claim 1 wherein the smoke sensing means comprises:

a. a phototransistor having its input junction operationally connected to the output of the pulsed D.C. power supply regulator through the cathode of a first diode and a seventh resistor in series connection, and having its base in photocommunication with the light receiver; and b. an amplifying transistor having its input junction operationally connected to the output of the pulsed D.C. power supply regulator through the cathode of the first diode and the seventh resistor and its base connected to the output junction of the phototransistor;

whereby the polarities associated with the operational connections of the first diode, the phototransistor and the amplifying transistor are such as to sense and amplify the light signal.

15. In a smoke detector as set forth in claim 1, the improvement in low supply voltage threshold adjuster comprising a second potentiometer resistor having one end operationally connected to the one end of the seventeenth resistor and the other end to ground.

16. In a smoke detector as set forth in claim 1, the improvement in alarm damper comprising a diode having its cathode operationally connected to the eighth and ninth transistors and its anode to ground.

17. A smoke detector operating on the principle of light interference by smoke, having a pulsed power supply for conserving energy, a pulsed alarm circuit, a warning of a short or opening in the smoke detector circuit, and a low A.C. supply voltage warning and automatic switchover to battery circuit, comprising:

1. a transformer operationally connected to a source of A.C. power and having secondary output terminals;

2. a full-wave bridge rectifier having input terminals operationally connected to the secondary output terminals of the transformer;

3. a power supply capacitor operationally connected across the output terminals of the bridge rectifier to ground;

4. a battery in series connection with a diode and both operationally connected across the output terminals of the bridge rectifier;

5. a first resistor operationally connected at one end to the high output terminal of said bridge rectifier;

a. a first capacitor operationally connected at one plate to the other end of said first resistor;

b. a second capacitor operationally connected at one plate to the other plate of said first capacitor and having its other plate operationally connected to ground;

c. a first PNP transistor having its emitter operationally connected to the other end of said first resistor and its base connected to the output of the power supply pulser;

d. a first NPN transistor having its base operationally connected to the collector of the first PNP transistor and its collector operationally connected to the output of the power supply pulser;

e. a third resistor having one end operationally connected to the emitter of the first NPN transistor and its other end operationally connected to the other plate of said first capacitor;

f. a fourth resistor having one end operationally connected to the other end of the third resistor and its other end operationally connected to ground;

g. a second PNP transistor having its emitter operationally connected to the source of D.C. power, its base operationally connected to the other end of the second resistor and its collector operationally connected to the output from said power supply switcher;

h. a fifth resistor operationally connected at one end to the output from the pulsed D.C. power supply;

i. a second NPN transistor having its collector operationally connected to the output from the pulsed D.C. power supply, its base operationally connected to the other end of said fifth resistor and its emitter operationally connected to the output from the pulsed D.C. power supply regulator;

j. a Zener diode having its cathode operationally connected to the other end of said fifth resistor and its anode operationally connected to ground;

k. a sixth resistor having one end operationally connected to the output from the pulsed D.C. power supply voltage regulator;

l. a first potentiometer having one end operationally connected to the other end of the sixth resistor;

m. a first L.E.D. having its anode operationally connected to the other end of the first potentiometer and its cathode operationally connected to ground and mounting in the lower end of the bore in the housing operationally focused to shine light up the axis of said bore;

n. a first diode having its anode operationally connected to the output from the pulsed D.C. power supply regulator;

o. a seventh resistor having one end operationally connected to the cathode of said first diode;

p. a light sensor including an output having its input operationally connected to the other end of said seventh resistor and mounting in the upper end of the bore in the housing operationally focused to receive light from down the axis of said bore;

q. an amplifier having a first input operationally connected to the other end of said seventh resistor and a second input operationally connected to the output from said light sensor;

r. an NPN phototransistor having its collector operationally connected to the input to and its emitter operationally connected to the output from said light sensor;

s. a third NPN transistor having its collector operationally connected to first input to said amplifier and to the output therefrom and its base operationally connected to the output from said light sensor;

t. a first diode having its anode operationally connected to the output from the pulsed D.C. power supply voltage regulator;

u. an eighth resistor having one end operationally connected to the output from the amplifier;

v. a ninth resistor having one end operationally connected to the cathode of the first diode;

w. a third PNP transistor having its emitter operationally connected to the other end of the eighth resistor and its base operationally connected to the other end of the ninth resistor;

x. a fourth NPN transistor having its collector operationally connected to the other end of the ninth resistor, its base operationally connected to the collector of the third PNP transistor and its emitter operationally connected to one end of a tenth resistor the other end of which connects to ground and to the output from the alarm trigger;

y. an eleventh resistor having one end operationally connected to the input to the alarm pulser;

z. a third capacitor having one plate operationally connected to the other end of the eleventh resistor;

aa. a twelfth resistor having one end operationally connected to the other plate of the third capacitor;

bb. a fourth PNP transistor having its emitter operationally connected to the source of D.C. power and its collector operationally connected to the other end of the twelfth resistor;

cc. a fifth PNP transistor having its emitter operationally connected to the base of the fourth PNP transistor, its collector operationally connected to the other end of the twelfth resistor and to the output from the alarm pulser;

dd. a thirteenth resistor having one end operationally connected to the base of said fifth PNP transistor;

ee. a fifth NPN transistor having its base operationally connected to the other end of the eleventh resistor, its collector operationally connected to the other end of the thirteenth resistor and its emitter operationally connected to ground;

ff. a magnetic horn having its input operationally connected to the output of the alarm pulser and its output operationally connected to ground;

gg. a fourteenth resistor having one end operationally connected to the anode of the first diode;

hh. a second L.E.D. having its anode operationally connected to the other end of the fourteenth resistor and its cathode operationally connected to ground;

ii. a sixth PNP transistor having its emitter operationally connected to the anode of the first L.E.D., its base operationally connected to the anode of the second L.E.D. and its collector operationally connected to the output from the open-short supervisor;

jj. a sixth NPN transistor having its emitter operationally connected to the base of the sixth PNP transistor, its base operationally connected to the emitter of the same and its collector operationally connected to the output from the open-short supervisor;

kk. a fifteenth resistor having one end operationally connected to the output from the pulsed D.C. power supply and its other end operationally connected to the output from the open-short supervisor;

ll. a second diode having its cathode operationally connected to the output from the open-short supervisor;

mm. a third diode having its cathode operationally connected to the output from the open-short supervisor;

nn. a second potentiometer having one end operationally connected to the anode of the third diode and its other end to ground;

oo. a sixteenth resistor having one end operationally connected to the output from the pulsed D.C. power supply and its other end operationally connected to the anode of the third diode;

pp. a seventeenth resistor having one end operationally connected to the anode of the third diode;

qq. a fourth diode having its cathode operationally connected to the other end of the seventeenth resistor;

rr. an eighteenth resistor having one end operationally connected to the other end of the seventeenth resistor;

ss. a nineteenth resistor having one end operationally connected to the output of the pulsed D.C. power supply regulator;

tt. a seventh PNP transistor having its emitter operationally connected to the other end of the eighteenth resistor and its base operationally connected to the other end of the nineteenth resistor;

uu. a seventh NPN transistor having its collector operationally connected to the base of the seventh PNP transistor and its base operationally connected to the collector of the same;

vv. a twentieth resistor having one end operationally connected to the emitter of the seventh NPN transistor and its other end operationally connected to ground;

ww. a fifth diode having its anode operationally connected to the base of the seventh PNP transistor and its cathode operationally connected with the output from the warning trigger;

xx. a fifth capacitor having one plate operationally connected to the base of the seventh PNP transistor and its other plate operationally connected to ground;

yy. a sixth diode having its anode operationally connected to the collector of the fifth PNP transistor;

zz. a sixth capacitor having one plate operationally connected to the cathode of the sixth diode and to the anode of the fourth diode and its other plate operationally connected to ground;

aaa. a twenty-first resistor operationally connected at one end to the cathode of the sixth diode;

bbb. a seventh diode having its anode operationally connected to the other end of the twenty-first resistor and its cathode operationally connected to the other end of the first resistor; and ccc. an eighth diode having its cathode operationally connected to the collector of the fifth PNP transistor and its anode operationally connected to ground.

* * * * *

UNITED STATES PATENT OFFICE

CERTIFICATE OF CORRECTION

Patent No. 4,065,759 Dated December 27, 1977

Inventor(s) Theodore E. Handing

It is certified that error appears in the above-identified patent and that said Letters Patent are hereby corrected as shown below:

The above patent is the joint invention of

-Theodore E. Handing and Ralph M. Barnett --.

Signed and Sealed this

Second Day of May 1978

[SEAL]

Attest:

RUTH C. MASON
Attesting Officer

LUTRELLE F. PARKER
Acting Commissioner of Patents and Trademarks